United States Patent [19]

Walter et al.

[11] 3,950,052

[45] Apr. 13, 1976

[54] SWIVELLING ELECTRICAL CONNECTION

[75] Inventors: Henry J. Walter, Wilton; William E. Springer, Shelton, both of Conn.

[73] Assignee: Clairol Incorporated, New York, N.Y.

[22] Filed: Aug. 7, 1975

[21] Appl. No.: 602,864

Related U.S. Application Data

[63] Continuation of Ser. No. 451,647, March 15, 1974, abandoned.

[52] U.S. Cl. ..... 339/8 R; 174/46; 339/101

[51] Int. Cl.[2] ..... H01R 39/00

[58] Field of Search ..... 339/8 R, 8 P, 58, 62, 101; 174/46

[56] References Cited

UNITED STATES PATENTS

| | | | |
|---|---|---|---|
| 1,090,238 | 3/1914 | Schwartz | 339/8 P |
| 1,762,422 | 6/1930 | Rohrdanz | 339/8 P |
| 3,093,432 | 6/1963 | King | 339/101 X |
| 3,437,976 | 4/1969 | Nelson | 339/8 R |

*Primary Examiner*—Roy Lake
*Assistant Examiner*—DeWalden W. Jones
*Attorney, Agent, or Firm*—David J. Mugford; George A. Mentis; Samuel J. DuBoff

[57] ABSTRACT

An electrical connection is made between an appliance and a power cord by means of a rotatable plug which is bonded to one end of the power cord and rotatably connected to a socket in the appliance. The plug effects electrical contact with the socket through a central contact member and an exposed concentric contact member which is coaxially disposed relative to the central contact member. The central contact member and the concentric contact member are engaged by spring contacts in the socket which allow the plug to rotate while always maintaining electrical contact. In order to isolate the electrical connection between the appliance and the plug from axial and transverse stresses, the plug is provided with a strain relief bushing which transfers stresses between the cord and appliance to the housing of the appliance. The bushing also allows the plug to rotate or swivel relative to the housing so that torsional stresses applied to the cord are kept to a minimum. To further reduce and distribute stresses on the cord, the plug has a tapered end portion with a series of parallel grooves therein. The tapered end portion extends at an angle to the axis of rotation of the plug.

16 Claims, 6 Drawing Figures

SWIVELLING ELECTRICAL CONNECTION

This is a continuation of application Ser. No. 451,647 filed Mar. 15, 1974 now abandoned.

BACKGROUND OF THE INVENTION

1. Field of the Invention

The present invention is directed to a novel electrical connection. More particularly, the present invention is directed to a novel electrical connection between an appliance and a power cord.

2. Technical Considerations and Prior Art

Many electrical appliances, especially grooming appliances such as hair curlers, hair dryers, etc., are connected by flexible electrical cords to power sockets. Since the applicances must often be manipulated and moved in a rather random fashion, stress is placed on the cord and the electrical connection between the cord and the appliance. This stress is perhaps most pronounced at the junction between the appliance and the cord. In prior art devices, there was therefor a tendency for electrical conductors carried by the cord to break which, of course, renders the associated appliance both unuseable and unsafe. In addition, there is a tendency in many prior art devices for tensional stresses on the cord to damage the electrical connection between the cord and the appliance.

These problems are recognized by the prior art and many attempts have been made to effect solutions. However, none of the solutions are readily adaptable to modern hand-held appliances which must be relatively inexpensive, light in weight, and generally uncomplicated.

Numerous existing patents disclose electrical connections which, among other things, attempt to deal with this problem of stress. Examples of such patents are U.S. Letters Pat. Nos. 1,743,118; 1,765,330; 2,257,506; 2,459,118; 2,941,177; 3,321,728; 3,336,559; 3,387,250; 3,437,976; 3,521,220, 3,585,564; and 3,629,784. All of the connectors disclosed by these patents are relatively heavy, complicated devices which are not suitable for light-weight, relatively inexpensive, hand-held devices. None of these patents illustrates a synthesis of technology to produce a connector of optimal configuration for the purposes to which this inventor has directed his efforts.

SUMMARY OF THE INVENTION

In view of the afore-mentioned deficiencies of the prior art, it is an object of the instant invention to provide a new and improved electrical connection.

Another object of the instant invention is to provide a new and improved electrical connection between a cord and an appliance, wherein the connection is designed to eliminate damaging tensional stress between the cord and the appliance.

It is still another object of the instant invention to provide a new and improved electrical connection between a cord and an appliance, wherein the connection allows the appliance and cord to swivel relative to one another in order to reduce torsional stresses between the cord and the appliance as the appliance is manipulated.

It is a further object of the instant invention to provide a new and improved electrical connection between a cord and an appliance, wherein stress between the cord and the appliance is transferred to the housing of the appliance instead of through electrical contacts of the connection.

It is a still further object of the instant invention to provide a new and improved electrical connection between a cord and an appliance, wherein the connection allows for the natural tendency of the cord to extend downwardly from the appliance while the appliance is being used.

It is an additional object of the instant invention to provide a new and improved electrical connection between a cord and an appliance, wherein the connection minimizes tensional and torsional stresses between the cord and the appliance, and is relatively inexpensive to manufacture.

It is still another object of the instant invention to provide a new and improved electrical connection between a cord and an appliance, wherein the electrical connection distributes bending stresses on the cord so that the bending stresses are not concentrated at one cross-section of the cord.

It is still a further object of the instant invention to provide a new and improved electrical connection for use between a cord and a hand-held appliance, wherein the connection is relatively light in weight so as to not materially add to the weight of the appliance.

In view of these and other objects of the instant invention, it is an overall object of the instant invention to provide a new and improved electrical connection between a cord and an appliance, wherein the connection will operate safely for many years under conditions which might adversely affect other types of connections.

In keeping with the afore-mentioned objects, the present invention contemplates an electrical connection between a power cord and an appliance having a housing, wherein the cord has a plug bonded thereto which is substantially non-removable but rotatably connected to the housing. The plug has a coaxial configuration in which a first central contact member is connected to one conductor of the cord, and a second concentric contact member coaxially disposed about the first central contact member forms a contact for the other conductor of the cord. Both contact members are retained in an integral molding of insulating material which extends around the junctions between the cord conductors and contact members and along a portion of the cord. In order to allow the plug to swivel relative to the housing, a stiff bushing or bearing is provided around the plug insulation to engage a circular opening in the end of the housing. The bushing has a flange therearound which engages the periphery of the opening so that tension applied along the cord will be transmitted to the housing instead of to the contacts of the connector. As the plug insulation extends along the cord, it is bent at an angle to the axis around which the plug rotates so that the cord will hang naturally from the appliance with the bent portion thereof reinforced by a relatively thick layer of insulation so that there is minimal flexure of the cord at the bend thereof.

Other objects and advantages of the afore-summarized instant invention will become apparent from the following description of a preferred embodiment, taken in conjunction with the attached drawings.

DESCRIPTION OF THE PREFERRED EMBODIMENT

Figure 1:
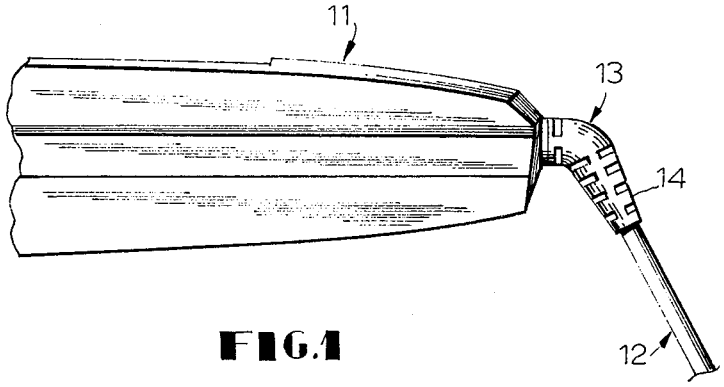
FIG. 1 is a side view showing an appliance such as a hair curler, hair dryer or the like, which is electrically connected to a power cord by an electrical connection, in accordance with the principles of the present invention.

Referring now to FIG. 1, there is shown an appliance, generally designated by the numeral 11, which is electrically connected to an attached power cord, designated generally by the numeral 12, by electrical connection, generally designated by the numeral 13. The appliance 11 may be any type of hand-held appliance, such as a hair dryer, hair curler, hedge trimmer, or the like. More particularly, the appliance 11 may be a steam curling iron, such as that described and claimed in copending patent application, Ser. No. 336,676, filed Feb. 28, 1973, and directed to a steam curling iron.

In the instant invention, the plug 13 is, as will be hereinafter described, rotatably or swivelly connected to the appliance 11 while being fixed to the cord 12 and the appliance 11. In addition, the connection 13 has a bent portion 14 which extends at an angle to the axis of rotation of the connection 13 so that the cord 12 generally extends from the appliance 11 at an angle to the general longitudinal axis of the appliance, which is also the axis of rotation of the connection 13. Consequently, as the appliance 11 is manipulated while curling the hair or performing some other function, the cord 12 is not twisted as the appliance 11 is rotated about its axis since the connection 13 allows the appliance to rotate relative to the cord. Since an appliance such as a hair dryer is probably more often held in a horizontal position with its power cord extending from one end and its operating portion disposed at the other end, the power cord in most instances will extend downwardly from the appliance due to gravity regardless of the location of the wall socket in which its opposite end is inserted. In the instant invention, the necessary tendency for the cord 12 to assume this angular orientation with reference to the longitudinal axis of the appliance 11 is accommodated by the bent portion 14 of the electrical connection 13. As will be hereinafter explained, the bent portion of the cord 12 is restrained in its flexure by yieldable insulation composing the connection 13, thereby drastically reducing fatigue imparted to the cord as the appliance 11 is manipulated.

Figure 2:
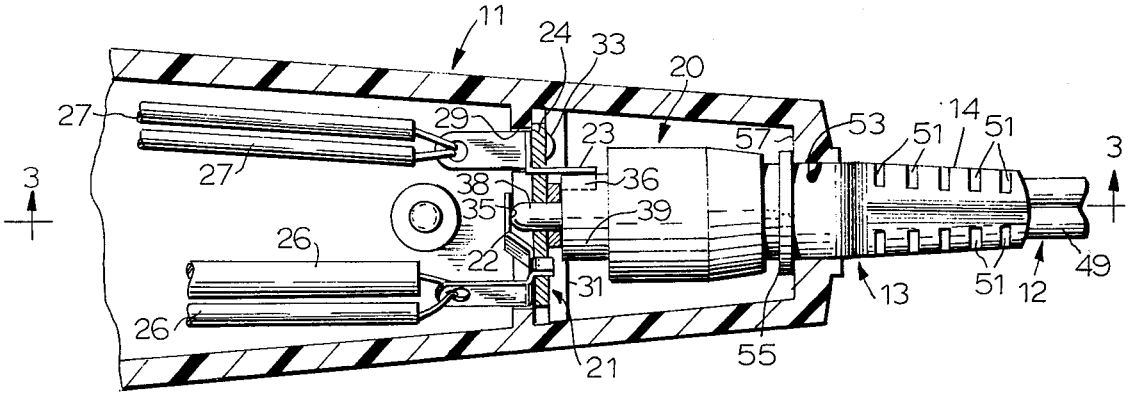
FIG. 2 is an enlarged top view, partially in section, of the appliance cord in connection shown in FIG. 1, illustrating how the contacts of the connection are engaged and how a plug which forms one part of the connection is journalled within a housing surrounding the appliance.
Figure 3:
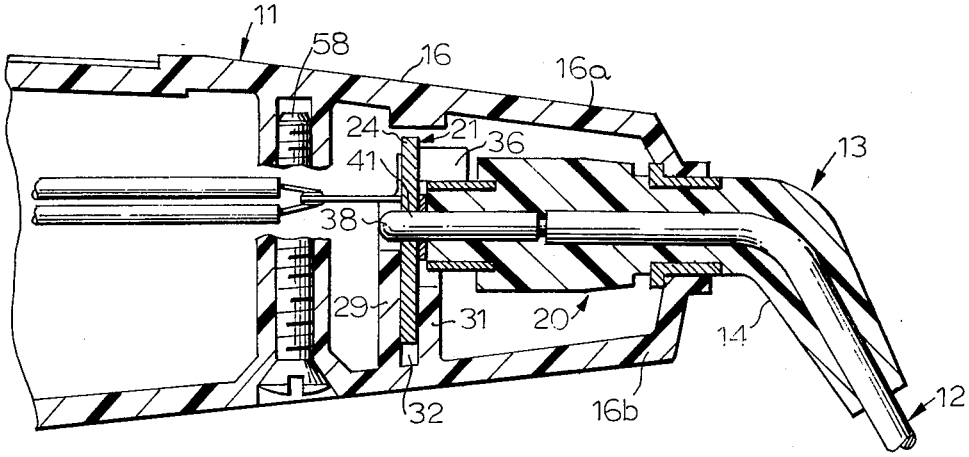
FIG. 3 is a side view, in section, taken along lines 3—3 of FIG. 2, illustrating the interior structure of the plug and further showing the relationship between the plug and the housing.

Referring now to FIGS. 2 and 3 wherein the appliance 11 is shown with the housing 16 thereof in section, it is seen that the electrical connection 13 has two portions; i.e., a plug, generally designated by the numeral 20, and a socket, generally designated by the numeral 21. The socket 21 in this embodiment has a pair of resilient contacts 22 and 23 which are mounted on an insulating board 24. The contact 22 has a pair of leads 26—26 which extend to the operating portion (not shown) of the appliance 11, while the contact 23 has a pair of leads 27—27 which also extend to the operating portion of the appliance. The insulating board 24 is held within the housing 16 by flanges 29, 31 which are spaced apart to define a slot 32 therebetween in which the board 24 nests. The board 24 is therefor rigidly held within the housing 16.

The contacts 22 and 23, which compose the socket 21, are conveniently attached to the board 24 by rivets 33 and have engagement portions 35 and 36 thereon which are urged against a axial or a central contact member which in this embodiment is a pin 38 and a concentric contact member which in this embodiment is a sleeve 39 of the plug 20. The pin 38 is conveniently received through a bore 41 through the insulating board 24 to engage the engagement portion 35 of contact 22 while the sleeve is circumferentially engaged by the contact 23.

Figure 4:
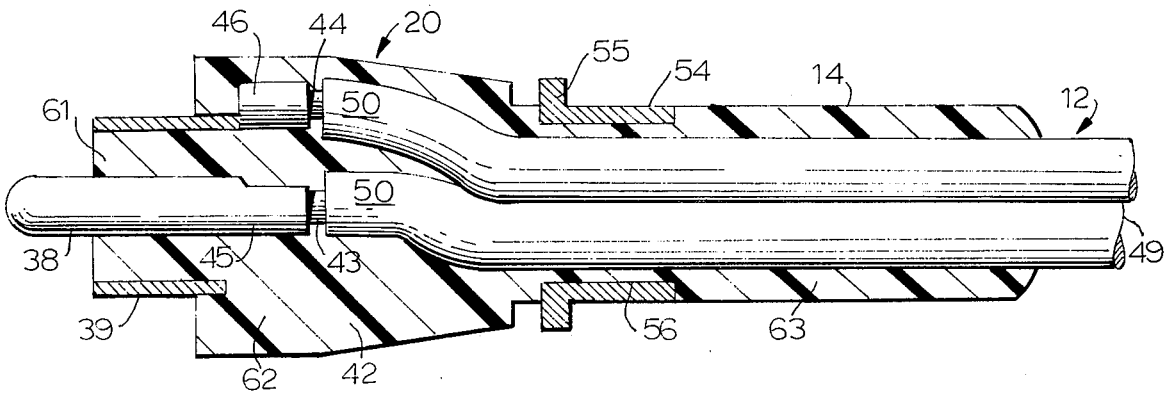
FIG. 4 is a top view of the plug, showing how conductors of the cord are attached to a pin contact and sleeve contact of the plug.

The structure of the plug 20 is perhaps best seen in FIGS. 3 and 4, which show that the contact pin 38 and the contact sleeve 39 which may be split are fixed in coaxial relationship relative to one another by insulation 42 from which the plug is molded or may if desired by a separate piece of insulation be separated. Prior to molding the insulation 42 around the contact pin 38 and the contact sleeve 39, conductors 43 and 44 (see FIG. 4) of the cord 12 are secured to the pin and sleeve. This may be accomplished in any convenient manner, but in the preferred embodiment is accomplished by crimping junction portions 45 and 46 of the pin 38 and sleeve 39 about the respective conductors 43 and 44. To conveniently perform this crimping, the pin 38 may be hollow so as to receive the conductor 43, while the sleeve 39 may have a tab 48 projecting therefrom which is deformed around the conductor 44. If desired, the junctions 45 and 46 may also utilize solder, or welding either in lieu of or in combination with crimping to secure the conductors 43 and 44. In place of tab 48, sleeve 39 may have a flange extending radially from said sleeve and having a flat portion to which conductor 44 is attached by soldering or if the board 21 carries pin 38 and plug 13 is a tubular member, connection can be made by soldering or welding.

As is seen in the figures, the cord 12 has its conductors 43 and 44 disposed parallel to one another and joined by the web portion 49 which is integral with the insulation 50 of the cord. Since the cord is configured in this way, it will bend more easily in a direction transverse to the lay of the conductors than in a direction parallel to the lay of the conductors. Accordingly, the bent portion 14 of the connection 13 which occurs on the plug 20 is disposed to hold the cord 12 bent in a plane transverse to the lay of the conductors 43 and 44.

Figure 5:
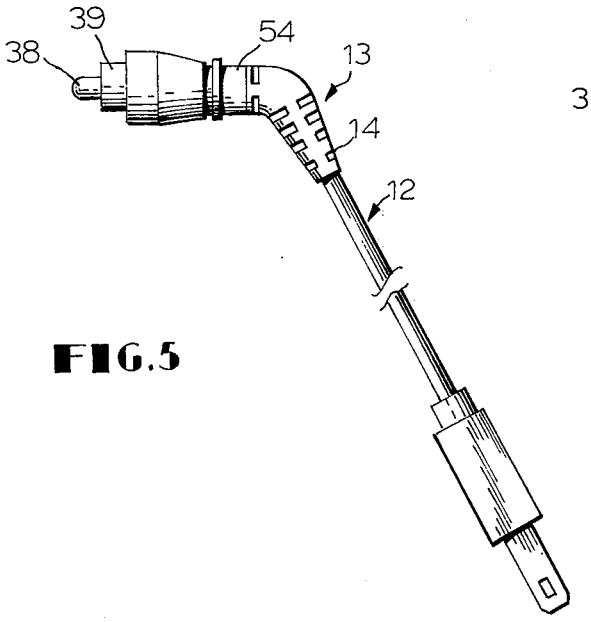
FIG. 5 is a side view showing the general structure of the plug, cord and a conventional wall plug located at the opposite end of the cord.
Figure 6:
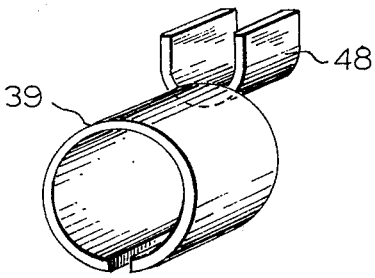
FIG. 6 is a perspective view of the sleeve contact of the plug.

As seen in FIG. 3, the bent portion 14 of the plug encases the cord 12 about the bend in the cord so that the cord is discouraged from flexing at the bend. Consequently, the conductors 43 and 44 (see FIG. 4) will not be subject to fatigue where they are bent but, rather, fatigue causing stresses will be distributed over the entire portion of the conductors encased in the insulation 42 of the plug 20. In order to allow limited flex in the bent portion 14, the bent portion 14 is provided with a series of parallel slots or grooves 51—51 which provide stress relief along the bent portion 14. Furthermore, the bent portion 14 is tapered, as seen in FIGS. 1, 3 and 5, so that flexibility is gradually increased from the bend in the cord 12 to the point at which the cord 12 emerges from the bent portion 14. By synthesizing this taper with the grooves 51—51, abrupt changes in flexibility of the cord 12 are avoided, thereby avoiding stress concentration at any single location along the cord 12 within the bent portion 14. By the time the cord 12 emerges from the bent portion 14, the cross-section of the bent portion 14 is such that very little flexure resistance is encountered by the cord 12 as it attempts to bend. In this way, stress concentration at one point is avoided, thus affording a safer, more long-lived connection between the appliance 11 and the cord 12.

As mentioned earlier in this description, the connection 13 allows the appliance 11 to rotate relative to the cord 12. This feature cooperates with the afore-described stress release system effected by the tapered, grooved, bent portion 14 to relieve the cord 12 of torsional stresses. In order to allow the plug 20 to rotate relative to the appliance 11, the plug 20 is equipped with the afore-described coaxial contacts 38 and 39 which remain in engagement with the contacts 22 and 23 while the plug rotates. To facilitate rotation of the plug 20 relative to the appliance 11, the housing 16 has a circular opening 53 in one end thereof through which the plug 20 passes, while the plug 20 has a stiff bushing 54 which forms a bearing that is journalled within the opening 53. In addition, the bushing 54 has a shoulder 55 extending therefrom which engages the rear inner wall 57 of the housing 16 when the plug 20 is seated in place to keep the plug from sliding out of the housing. The bushing 54 is preferably made of a low friction plastic, such as an acetal resin, so that it will readily rotate within the housing 16 which is also made of plastic.

In the illustrated embodiment, the insulation 42 is bonded to the insulation 50 forming a jacket around the conductors 43 and 44, while the bushing 54 is retained within a circular groove 56 formed in the plug 20, so that the bushing 54 cannot reciprocate longitudinally with relation to the plug. By using this configuration, tensional stress applied along the cord 12 is absorbed by the housing 16 since the shoulder 55 is simply pulled back against the rear wall 57 of the housing upon the application of stress. The contacts 22 and 23 of the socket and the coaxial contacts 38 and 39 of the plug 20 are therefor unaffected by tension on the cord 12.

In assembling the plug 20 to the appliance 11 in which the socket 21 is already seated, the housing 16 is separated into upper and lower halfs **16*a* and 16*b*, respectively. Before assembling the upper half 16*a* of the housing to the lower half 16*b*, the plug 20 is inserted at an angle into the housing with the pin contact 38 directed into the bore 41. The engagement portion 35 of the contact 22 engages the pin 38 and urges the plug 20 back toward the rear wall 57 so that the shoulder 55 abutts the rear wall. The top half 16*a* is then placed over the lower half 16*b* and a screw 58** unites the two halfs.

In forming the plug 20, the most convenient procedure is to slide the bushing 54 over the cord 12 and then crimp the pin 38 and the sleeve 39 to the contacts 43 and 44, respectively, of the cord. This assembly is then placed in a mold (not shown) which, in a conventional way, holds the pin 38, sleeve 39, bushing 54 and cord 12 in proper relation, and is then filled with an elastomeric compound, such as PVC. The PVC fills all of the voids between the component parts, acts as an insulator and bonds the insulating jacket 50 of the cord 12 to the insulation 42. By this procedure, a slightly flexible plug 20 is conveniently and inexpensively formed.

The elastomeric insulation 42 may be described as having three portions. A first portion 61 separates the pin 38 from the sleeve 39, while leaving the sleeve exposed and holding the pin in projected relation with respect to the sleeve. A second portion 62 of the plug insulation surrounds the junctions between the conductors 43 and 44 and the junction ends 45 and 46 of the pin 38 and sleeve 39, while slightly overlapping a portion of the sleeve. A third portion 63 has an axial section which extends for a distance along the axis of rotation of the plug 20 and then, with a transverse section, bends to form the bent portion 14. As previously described, the bent portion 14 holds the cord 12 in the bent configuration shown in FIGS. 1, 3 and 5, while the axial section provides the groove 56 which retains the bushing 54.

From the afore-described embodiment, it is seen that an electrical connection in accordance with the instant invention provides a structurally simple connection which is highly reliable, safe and economical to produce. Inasmuch as the instant invention is subject to many variations, modifications and changes in detail, it is intended that all matter described above or shown in the accompanying drawings be interpreted as illustrative and not limiting. The scope of the instant invention is to be limited only by the following appended claims.

What is claimed is:

1. In an attached electrical connection for an appliance having a housing wherein said connection and said housing cooperate to allow the plug to rotate, wherein the connection uses a rotatable plug for connecting a pair of insulated leads to a socket associated with the appliance, the plug comprising:

an axial contact member having a free end for establishing electrical contact with the socket and a junction end attached to one of the leads;

a concentric contact member having a contact area thereon for establishing electrical contact with the socket and having a junction thereon to which the other of said leads is attached; and an integral insulating means of elastomeric material surrounding and in contact with the insulation surrounding the leads, wherein said insulating means comprises:

a first portion disposed between and in contact with said axial contact member and said concentric contact member, said first portion holding said axial contact member in spaced coaxial relation to said concentric contact member;

a second portion surrounding and in contact with the junctions between the axial contact member and said one lead and the concentric contact member and said other lead, but being axially displaced relative to said first portion to expose the contact area of said concentric contact member for subsequent electrical contact; and a third portion extending from said second portion surrounding and in contact with the insulation surrounding said leads, said third portion having an axial section in axial alignment with said first and second portions and terminating in a transverse section extending transverse to the axial extent of said plug and said first and second portions and being more flexible than the axial section.

2. The plug of claim 1, wherein the transverse section of said third portion of said insulating means has grooves formed therein which encourage the flexibility thereof.

3. The plug of claim 1, wherein the leads are retained by said transverse section to extend in the same direction while held in parallel relation to one another.

4. The plug of claim 3, wherein said transverse section has grooves therein which extend in parallel directions transverse to the direction in which the leads extend while retained by the transverse section so that the transverse section and portions of the leads retained therein tend to bend toward the axis of the first and second portions of the insulation rather than twisting about said axis.

5. The plug of claim 1, wherein said plug further includes a stiff cylindrical bushing surrounding said axial section and being restrained from axial movement relative to said axial section, said bushing serving as a bearing to allow said plug to swivel with respect to said housing.

6. The plug of claim 5, wherein said bushing has a flange extending therearound which engages the housing to transmit forces having components applied in the axial direction of said axial contact member and said first and second portions to said housing rather than through the connection effected by the plug.

7. The plug of claim 6, wherein the bushing is made of a self-lubricating material to facilitate swivelling of the plug relative to the housing.

8. The plug of claim 1, wherein the section of the concentric contact member to which the lead is attached is a tab which extends threfrom and is crimped around the lead to establish the connection.

9. The plug of claim 1 wherein the axial contact member is a metallic pin and the concentric contact member is a metallic sleeve.

10. In an electrical connection having the plug of claim 9, said socket including an insulating board with a hole therethrough to receive said pin, said board having a first resilient contact member mounted thereon and extending across said hole, said first resilient contact when engaged by said pin urging said plug into abutting relation with said housing at a location adjacent said third portion of said insulating means and said board having a second resilient contact member mounted thereon and extending in a direction normal to said first resilient contact member to engage said contact area of said metallic sleeve, thereby allowing said plug to remain in electrical contact with said socket while rotating relative thereto.

11. The electrical connection of claim 10, wherein the third portion has a stiff bushing means affixed thereto which has a flange therearound that engages said housing upon the urging of said pin with said first resilient contact member and wherein said housing completely surrounds said bushing with said flange disposed internally of said housing to permanently hold said plug in said housing.

12. The plug of claim 2, wherein the transverse section tapers as it extends away from the axial section to provide a gradual increase in flexibility in order to minimize stress concentration.

13. In an electrical connection having the plug of claim 1, said socket including an insulating board with a hole therethrough to receive said axial contact member, said board having a first resilient contact member mounted thereon and extending across said hole, said first resilient contact when engaged by said axial contact member urging said plug into abutting relation with said housing at a location of adjacent said third portion of said insulating means and said board having a second resilient contact member mounted thereon and extending in a direction normal to said first resilient contact member to engage said contact area of said concentric contact member, thereby allowing said plug to remain in electrical contact with said socket while rotating relative thereto.

14. In an attached electrical connection for an appliance having a housing, wherein said connection and said housing cooperate to allow the plug to rotate, wherein the connection uses a rotatable plug for connecting a pair of insulated leads to a socket associated with the appliance, the plug comprising:

an axial contact member having a free end for establishing electrical contact with the socket and a junction end attached to one of the leads;

a concentric contact member having a contact area thereon for establishing electrical contact with the socket and having a junction thereon to which the other of said leads is attached; and an integral insulating means of elastomeric material surrounding and in contact with the insulation surrounding the leads, wherein said insulating means comprises:

a first portion disposed between and in contact with said axial contact member and said concentric contact member, said first portion holding said axial contact member in spaced coaxial relation to said concentric contact member;

a second portion surrounding and in contact with the junctions between the axial contact member and said one lead and the concentric contact member and said other lead, but being axially displaced relative to said first portion to expose the contact area of said concentric contact member for subsequent electrical contact; and a third portion extending from said second portion surrounding and in contact with the insulation surrounding said leads, said third portion having at least one axial section in axial alignment with said first and second portions and having a cylindrical bushing surrounding said axial section and being restrained from axial movement relative to said axial section, said bushing having a flange extending therearound which engages the periphery of an opening in the end of the housing and serving as a bearing to allow said plug to swivel with respect to said housing.

15. The plug of claim 14 wherein the axial contact member is a metallic pin and the concentric contact member is a metallic sleeve.

16. In an electrical connection having the plug of claim 14, said socket including an insulating board with a hole therethrough to receive said axial contact member, said board having a first resilient contact member mounted thereon and extending across said hole, said first resilient contact when engaged by said axial contact member urging said plug into abutting relation with said housing at a location adjacent said third portion of said insulating means and said board having a second resilient contact member mounted thereon and extending in a direction normal to said first resilient contact member to engage said contact area of said concentric contact member, thereby allowing said plug to remain in electrical contact with said socket while rotating relative therein.

* * * * *